United States Patent [19]

Lebouc et al.

[11] Patent Number: 4,592,691

[45] Date of Patent: Jun. 3, 1986

[54] TELEMANIPULATOR FOR OPERATION IN A WATERBOX OF A STEAM GENERATOR

[75] Inventors: Bernard Lebouc, Courbevoie; Georges Clar, Lyons, both of France

[73] Assignee: Framatome & Cie, Courbevoi, France

[21] Appl. No.: 424,771

[22] Filed: Sep. 27, 1982

[30] Foreign Application Priority Data

Oct. 5, 1981 [FR] France ..... 81 18669

[51] Int. Cl.[4] ..... B25J 15/00

[52] U.S. Cl. ..... 414/4; 414/749; 901/14

[58] Field of Search ..... 414/1-7, 414/749; 901/14

[56] References Cited

U.S. PATENT DOCUMENTS 4,303,368 12/1981 Dent et al. ..... 414/4 X

*Primary Examiner*—Terrance L. Siemens

*Attorney, Agent, or Firm*—Pollock, Vande Sande & Priddy

[57] ABSTRACT

Telemanipulator for operation in a waterbox of a steam generator for attachment underneath the tubeplate of the latter. The device has expandable grippers mounted on arms carried by a bearer unit, for engaging and locking as required in the orifices in the tubeplate, with means enabling independent movement of the apparatus underneath the tubeplate while remaining always suspended by at least two grippers. The bearer unit has four independent arms each equipped with two expandable grippers, and on the portion of it opposite from the tubeplate it supports an arm having a number of members hinged together, the end member of the arm being equipped with tool attachment means, the whole of the arm being in turn revolvable about the axis of the unit perpendicular to the tubeplate, with remote-controlled means for adjusting and maintaining the angular position of the arm with respect to the bearer unit and the angular position of each of the members of the arm relative to one another. The invention is applicable especially to steam generators in nuclear power stations.

3 Claims, 4 Drawing Figures

TELEMANIPULATOR FOR OPERATION IN A WATERBOX OF A STEAM GENERATOR

FIELD OF THE INVENTION

The present invention refers to a telemanipulator more especially intended for supporting and moving the tools necessary for operations inside a waterbox of a steam generator in a pressurized-water nuclear power station.

BACKGROUND OF THE INVENTION

In a pressurized-water nuclear power station, the very numerous tubes in the tube bundles in the steam generators must be subjected to periodical operations of checking and maintenance such, for example, as welding operations, the putting in place of shut-off plugs for neutalizing defective tubes, or operations on the lining inside tubes. These maintenance operations must be carried out from the waterbox, i.e., in a highly radioactive field. It is therefore necessary to employ remote-controlled apparatus in order to limit human interventions to the simple putting in place of the material. In addition, the steam generators generally have vertical tubes, i.e., the tubeplate is then on the "ceiling" of the waterbox.

It may likewise be necessary to operate upon the inner walls of the waterbox, e.g., in order to check their surface state.

Apparatus capable of being moved by remote control underneath the tubeplate of a steam generator have already been produced.

For example, the French patents published under Nos. 2.309.314 and 2.457.741 describe such apparatus having two perpendicular arms each equipped at both ends with an expandable gripper which can engage in the orifices in the tubeplate. By the actions of carriages and jacks, it is possible to give independently to each arm (a) motions perpendicular to the plate in order to engage or disengage the grippers in the orifices, and (b) step-by-step motions parallel with the plate, thus enabling independent movement of the apparatus by "creeping" underneath the plate. While in motion, the apparatus always remains suspended by at least two grippers and by four grippers in the working position.

Such apparatus displays the disadvantage of a rather large general bulk. More importantly, when an apparatus is in a working position suspended from its four grippers it is possible to operate upon only a very limited number of orifices in the plate. In the version of French Pat. No. 2.309.314, designed simply for guides for check probes, only four tubes are accessible; in the version of French Pat. No. 2.457.741, which enables the use of more complicated tools such, for example, as welding heads, only one orifice in the plate is within the field of action of the tool which can move only in a dihedron left free by the supporting arms. This is rather a nuisance every time that the same operation must be carried out upon a series of orifices in the same zone of the plate, because for each change of orifice the tool carrier must then be moved, i.e., one must disengage one arm, move it by one pitch and engage it again in the plate, and repeat the three operations on the other arm, with the result that the times for movement, which are dead times, are longer than the effective operational times.

Furthermore, each motion includes phases during which the tool carrier remains suspended by only two grippers, this greatly restricts the weight of the tools which can be employed.

It will further be observed that these apparatuses enable working only underneath the tubeplate itself, whereas operations may also be necessary on the inner walls of the waterbox.

Finally, although, for example, in the apparatus described in French Pat. No. 2.457.741 it has been possible to provide a small turret in order to receive various tools on standby, this in practice is only possible for small tools because of the limited load which can be supported by two grippers. In practice it is frequently necessary to change the tools on the tool carrier, making it necessary to enter the highly radioactive waterbox more often.

SUMMARY OF THE INVENTION

The present invention enables a telemanipulator apparatus to be made available which is both of greater capacity and more versatile, while reducing interventions of personnel in a radioactive environment.

Hence the invention relates to a telemanipulator for operation in a waterbox of a steam generator, intended to be attached underneath the tubeplate of the generator, the apparatus being of the type having expandable grippers for engaging and locking as required in the orifices in the tubeplate, mounted on arms carried by a bearer unit, with means for giving each arm independently, firstly motions perpendicular to the plate in order to engage or disengage the grippers in the orifices and secondly step-by-step motions parallel with the plate, thereby enabling independent movement of the apparatus underneath the tube-plate while keeping it always suspended by at least two grippers.

In accordance with the invention, the bearer unit supports four independent arms each equipped with two expandable grippers, and on the portion of it opposite from the tubeplate the bearer unit supports an arm having a number of members hinged together, the end member of the arm being equipped with means for attachment of tools, and the whole of the arm being in turn revolvable about the axis of the unit perpendicular to the tubeplate; the apparatus includes remote-controlled means for adjusting and maintaining the angular position of the arm with respect to the bearer unit, and the angular position of each of the members of the arm relative to one another.

In accordance with a particular embodiment of the invention, the bearer unit consists of a tubular frame with guide bars uniformly distributed in groups of two about its axis, each arm consisting of a carriage engaging with each pair of bars, the grippers being in turn carried by a slide block which can be moved along the carriage perpendicular to the guide bars.

BRIEF DESCRIPTION OF THE DRAWINGS

The invention will be better understood by referring to a particular embodiment given by way of example and shown in the attached drawings.

DETAILED DESCRIPTION

Figure 1:
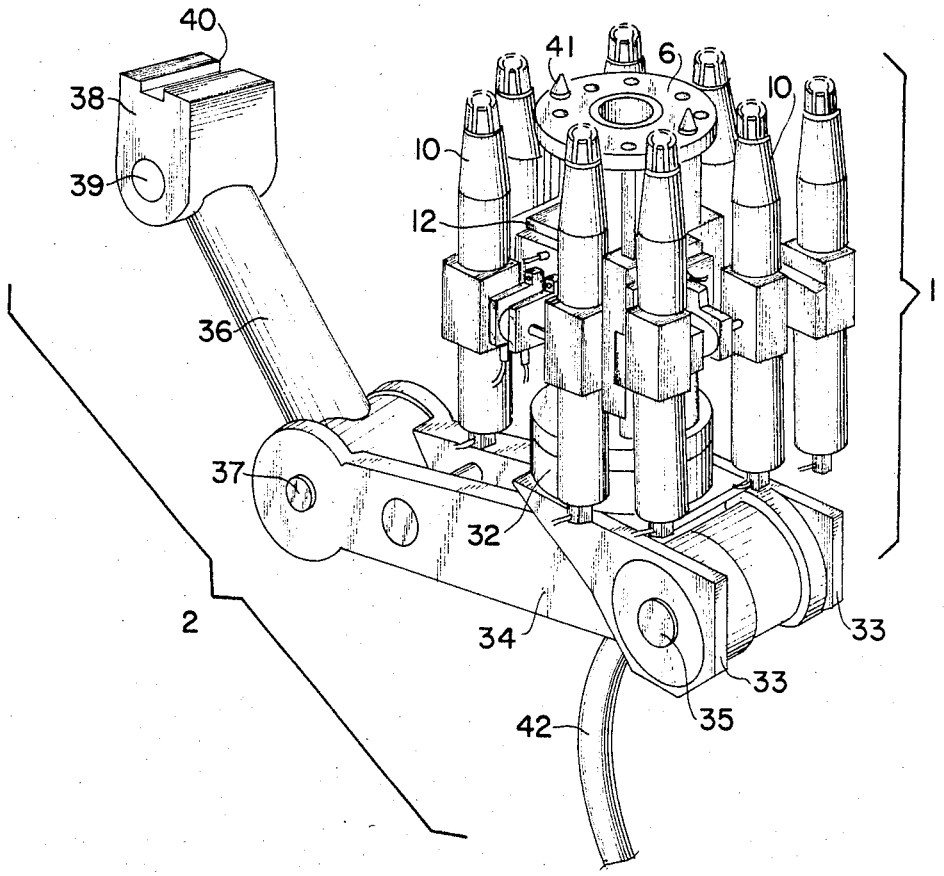
FIG. 1 is a perspective view of the whole of the apparatus.

Referring first of all to FIG. 1 it will be seen that the apparatus includes a bearer unit designated as a whole by 1, and equipped with coupling grippers 10 and means of movement of these grippers in order to provide the movement of the apparatus underneath the tubeplate. The unit 1 supports an articulated manipulator 2 which forms the tool carrier proper.

Figure 2:
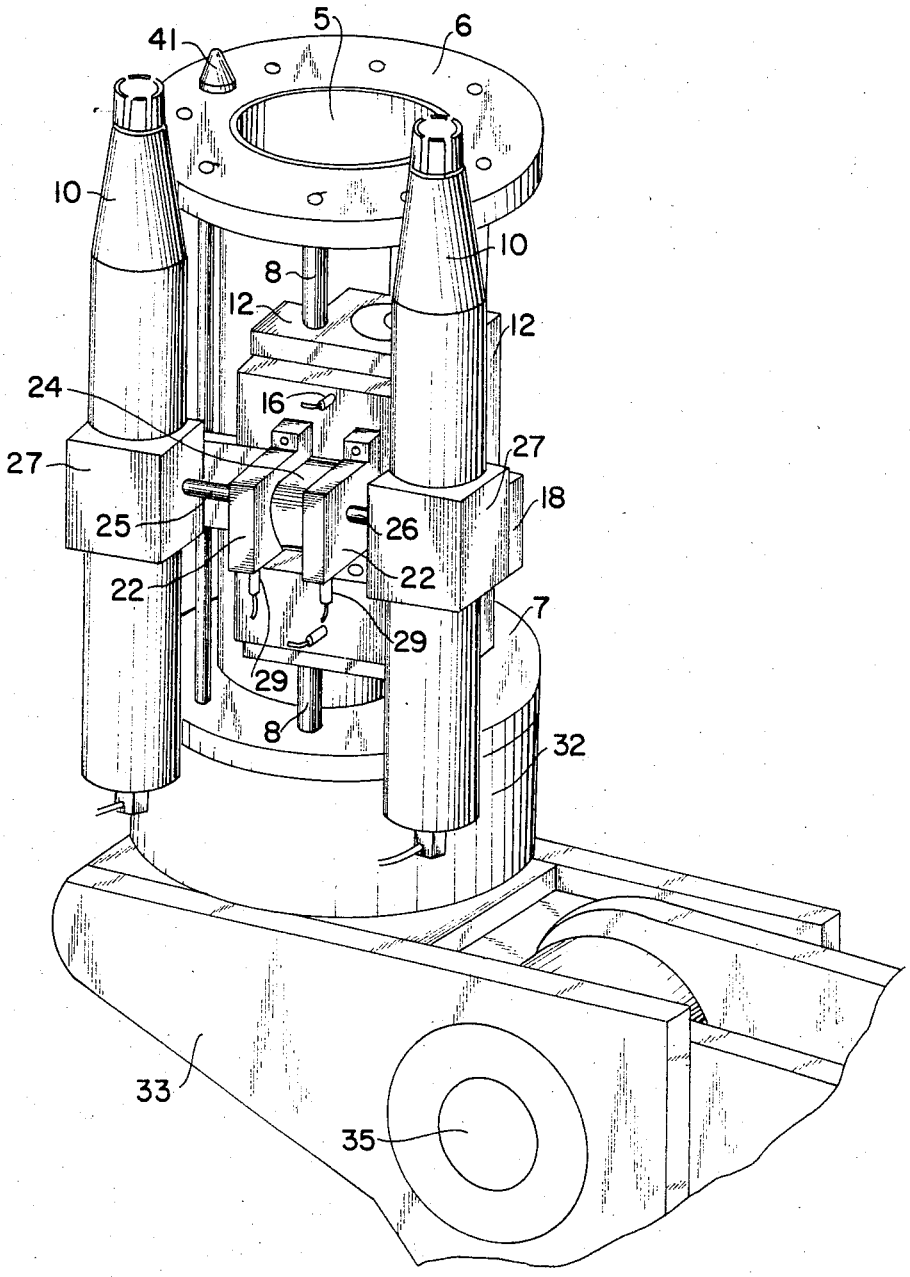
FIG. 2 is a perspective view showing the mounting of one arm movable upon its carriage for movement perpendicular to the plate.
Figure 3:
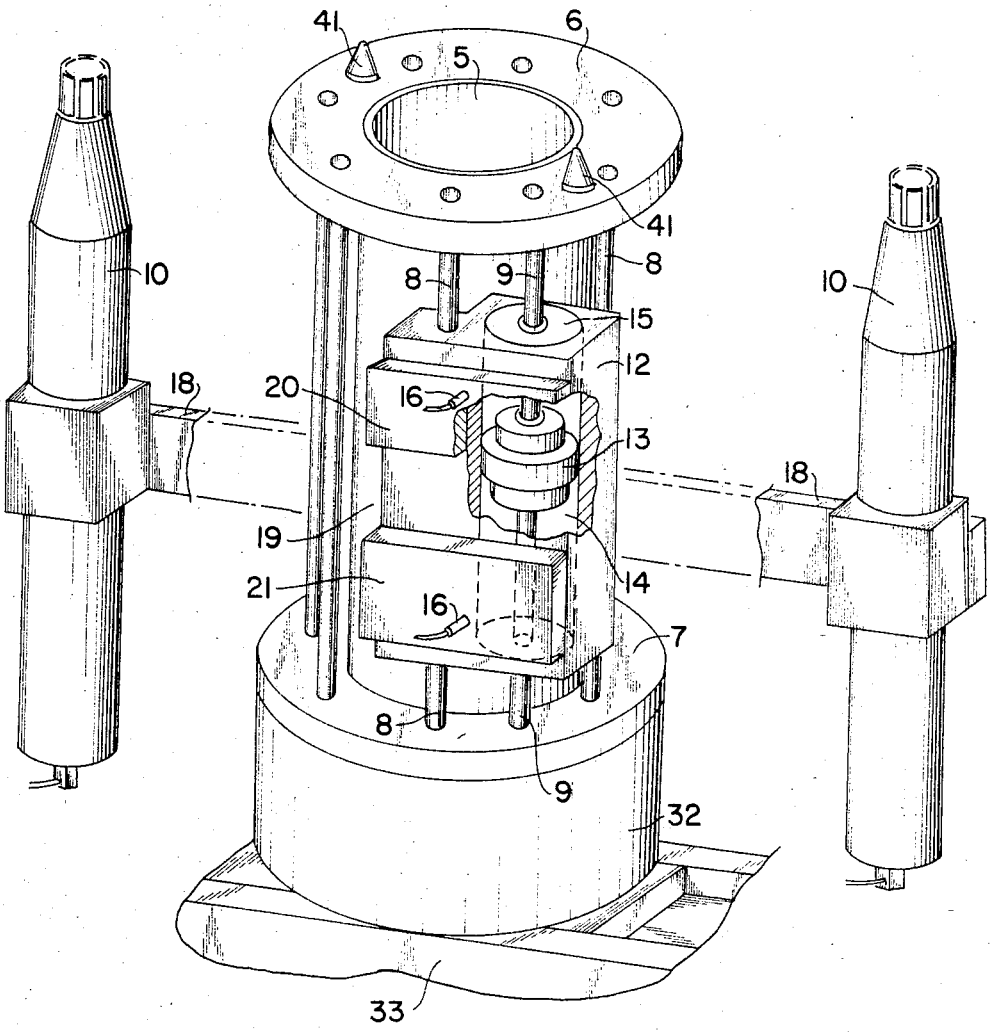
FIG. 3 shows the means employed for the movement of the carriage.

The bearer unit 1, which can be seen more clearly in FIGS. 2 and 3, consists here of a tubular frame 5 bearing two annular cheeks 6 and 7 at its ends The cheeks 6 and 7 are likewise connected by eight guide bars 8,9 regularly distributed in groups of two around the frame 5. The apparatus is equipped with eight fail-safe expandable grippers 10 for coupling of the usual type, i.e., the expandable end is normally in the expanded position, hence in the locked and coupled position when it is engaged in one of the orifices in the plate. It is by the controlled action of the incorporated pneumatic or electrical jack that the expandable portion may be retracted in order to uncouple the gripper; hence in the event of loss of pneumatic or electrical supply the apparatus will remain coupled to the plate. A more complete description of such expandable grippers may be found in the above-mentioned French Pat. No. 2.309.314.

The unit 1 includes four identical assemblies or arms such as those shown in FIGS. 2 and 3. Hence each arm carries two grippers 10 and is associated with one pair of bars 8,9.

The arm includes a slide block 12 which may be moved along the bars 8,9, i.e., perpendicularly to the tubeplate when the apparatus is in place. The slide block 12 is simply engaged over the bar 8 which has only a guiding role. The bar 9, on the contrary, forms the rod on opposite sides of a fixed piston 13 which slides in relative motion in a bore 14 in the slide block 12. The bore 14 is closed at each end by a head 15 through which the bar 9 passes, so that a double-acting jack having a fixed piston is formed, the movable body of which is the slide block 12 itself. The connections 16 enable feeding of one or the other chamber of the jack and consequently the parallel movement of the slideblock along the bars 8 and 9.

The two grippers 10 are attached to the ends of a spacer crossbar 18 which slides in a slide 19 formed on the front face of the slide block 12, through the free space between two plates 20,21 integral with the slide block 12. The crossbar 18 is retained in the slide 19 by two supports 22 which are attached to the plates 20,21 and which straddle the crossbar 18 without interfering with its transverse movement.

Each support 22 likewise forms one of the two heads of a double-acting jack the body 24 of which encloses a piston having two rods 25,26 which pass through the supports 22. The total length of the assembly of the piston and its rods 25,26 is equal to the inside distance between the supports 27 of the grippers 10, so that the ends of the rods 25 and 26 are always in contact with the two supports 27. The connections 29 enable the supply of one or the other chamber of the jack 24, which brings about the transverse movement of the assembly of the crosspiece 18 and the two grippers 10 which it supports. The total travel of the jack 24 is equal to one pitch of the tubes in the tubeplate, while of course the center distance between the two grippers 10 is equal to a whole multiple of this pitch.

The lower cheek 7 supports a rotary crown 32 upon which the whole of the tool carrier arm 2 pivots about the axis of the tubular frame 5. The arm 2 includes a first member 33 forming a head offset with respect to the axis of rotation of the crown 32. A second member 34 is hinged onto 33 at 35. A third member 36 is hinged in the same way onto the other end of 34 at 37. Finally a tool carrier slide block 38 is hinged at 39 to the other end of 36. The slide block 38 is equipped with the usual means of seizing and holding tools, these being means which are simply symbolized here (FIG. 1) by a groove 40.

The axes of the hinges 35,37 and 39 are parallel with one another and perpendicular to the axis of the frame 5. Each hinge, including hinges 35,37 and 39 and that of the head 33 onto the crown 32, is equipped with an internal motor for angular positioning which by an ordinary master-slave system enables each member of the arm 2 to reproduce by remote control the movements of similar members of an arm manipulated on a replica by an operator outside. The sleeve 42 brings together all the circuits of this remote control.

It may be seen that one has thus achieved a particularly compact apparatus thanks, in particular, to the internal jack for the movement of each slideblock 12. In spite of the presence of eight grippers for coupling, which enables a heavy load of tools to be supported, the apparatus nevertheless passes without difficulty through the manhole for access to the interior of the waterbox. Of course, at the time of the introduction of the apparatus into the waterbox the hinged arm is extended, with the result that the maximum transverse bulk of the whole is the diametral bulk across the grippers 10, which is a bulk less than the diameter of the manhole.

The positioning of the apparatus in suspension underneath the tubeplate is effected in the same fashion as for previous apparatus, with centering by the dollies 41 on the upper cheek which become engaged in two orifices in the plate, followed by engagement of the whole of the eight grippers in other orifices in order to ensure coupling to the plate.

Figure 4:
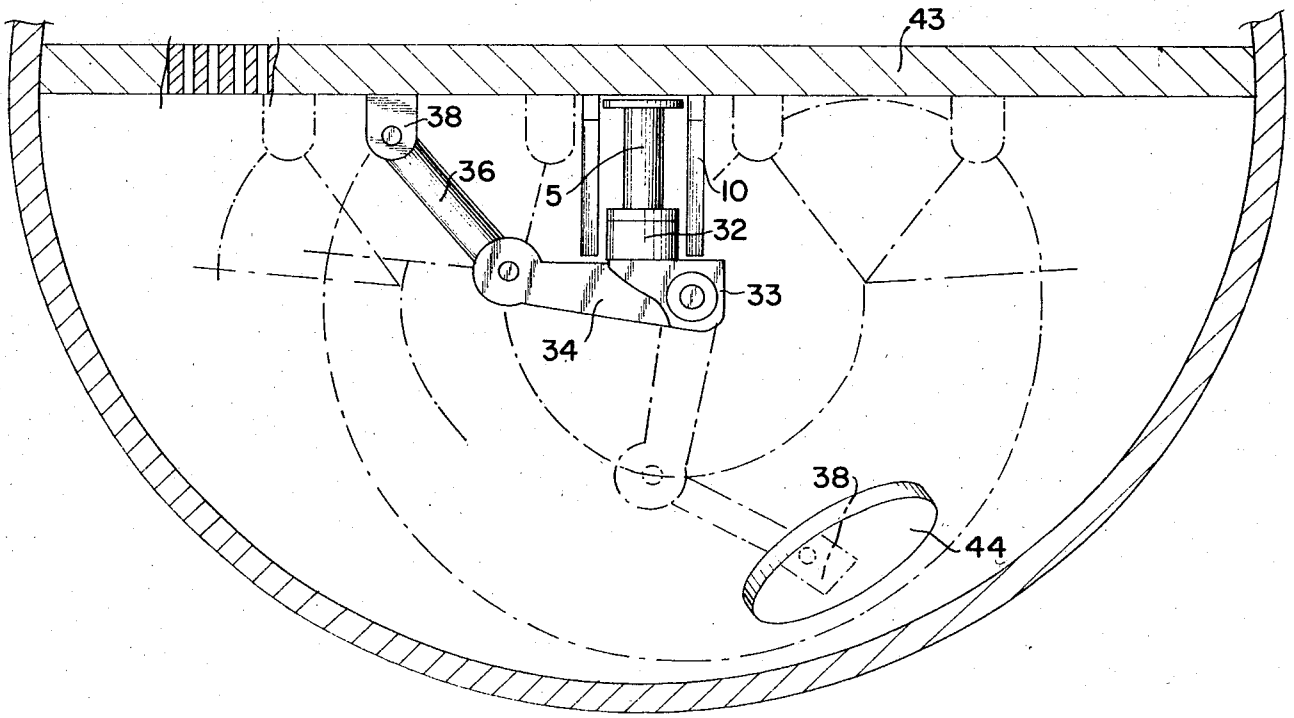
FIG. 4 shows the field of action of the apparatus in the watearbox assembly, from a fixed position underneath the tubeplate.

When the apparatus is in place underneath the tubeplate 43, the extent may be seen from FIG. 4, of the zone accessible to the tool carrier 38 without having to move the apparatus, and simply by varying the relative angular position of the members 34 and 36 and the angular position of the head 33 with respect to the crown 32. The zone which can be swept by the tool carrier 38 represents here nearly half the surface of the tubeplate. But in addition, the tool-carrier 38 may likewise be brought close to any one portion of the inner walls of the waterbox, whether it is a question of the spherical portion or else of the plane surface of the partition for separation of the hot water box from the cold water box. The tool carrier 38 may also be brought up to the manhole 44 in order to receive a new tool.

Of course if it is then required to move the apparatus towards another location on the tubeplate, one will proceed as with the previous apparatus, by disengaging two groups of opposite grips, moving them by one pitch in the same direction in order to engage them in four different orifices, then moving the frame in relative motion after having disengaged the other four grippers which will then in turn also be engaged again in different orifices. It may be noted that during such a manoeuvre the apparatus always remains suspended by a minimum of four grippers, which doubles its load capacity relative to the previous apparatus.

The apparatus lends itself particularly well to repetitive operations such, for example, as systematic blocking off of the tubes of a defective zone. One can then by means of the manipulator arm 2 come and take the plugs one after another through the hole 44 after having inserted the previous one, and without having to move the carrier unit 1 between each operation.

We claim:

1. A telemanipulator for operation in a waterbox of a steam generator and intended for attachment underneath a tubeplate of said generator, of the type having expandable grippers for engaging and locking as required in orifices in said tubeplate, mounted on arms carried by a bearer unit, with means for giving each arm, independently, (1) motions perpendicular to said plate in order to engage and disengage said grippers in said orifices, and (2) step-by-step motions parallel with said plate, thereby enabling independent movement of said apparatus underneath said tubeplate while keeping it suspended at all times by at least two grippers, wherein:

(a) said bearer unit supports four independent arms each equipped with two expandable grippers; and (b) on its portion remote from said tubeplate, said bearer unit supports an arm having a number of members hinged together, an end member of said arm being equipped with tool attachment means, the entire said arm being in turn revolvable about the axis of said bearer unit perpendicular to said tubeplate;

(c) and comprising remote-controlled means for adjusting and maintaining the angular position of said arm with respect to said bearer unit and the angular position of each of said members of said arm relative to one another.

2. A telemanipulator according to claim 1, wherein said bearer block comprises a tubular frame having guide bars uniformly distributed in groups of two about its axis, each said arm comprising a carriage engaging with each said pair of bars, said grippers being in turn carried by a slide block which moves along said carriage perpendicular to said guide bars.

3. A telemanipulator according to claim 2, wherein for each said carriage one of said two guide bars forms a fixed rod of a piston of a double-acting jack the body of which is formed by said carriage itself, said jack so formed being employed for the movement of each said arm perpendicular to said tubeplate.

* * * * *